US012279652B2

(12) United States Patent
Zhao et al.

(10) Patent No.: US 12,279,652 B2
(45) Date of Patent: Apr. 22, 2025

(54) ATOMIZATION ASSEMBLY AND ELECTRONIC CIGARETTE

(71) Applicant: SHENZHEN FIRST UNION TECHNOLOGY CO., LTD., Shenzhen (CN)

(72) Inventors: Xiangguo Zhao, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 442 days.

(21) Appl. No.: 17/756,499

(22) PCT Filed: Nov. 26, 2020

(86) PCT No.: PCT/CN2020/131869

§ 371 (c)(1),
(2) Date: May 26, 2022

(87) PCT Pub. No.: WO2021/104389

PCT Pub. Date: Jun. 3, 2021

(65) Prior Publication Data

US 2023/0000158 A1 Jan. 5, 2023

(30) Foreign Application Priority Data

Nov. 26, 2019 (CN) ..... 201922073083.8

(51) Int. Cl.
*A24F 40/46* (2020.01)
*A24F 40/10* (2020.01)
*A24F 40/42* (2020.01)

(52) U.S. Cl.
CPC ..... *A24F 40/46* (2020.01); *A24F 40/10* (2020.01); *A24F 40/42* (2020.01)

(58) Field of Classification Search
None
See application file for complete search history.

(56) References Cited

U.S. PATENT DOCUMENTS 11,470,880 B2 * 10/2022 Ouyang ..... A61M 15/06
2015/0184846 A1 7/2015 Liu
(Continued)

FOREIGN PATENT DOCUMENTS

CN 106690425 A 5/2017
CN 206303214 U 7/2017
(Continued)

*Primary Examiner* — Ross N Gushi
(74) *Attorney, Agent, or Firm* — Proi Intellectual Property US

(57) ABSTRACT

Provided are an atomization assembly and an electronic cigarette. The electronic cigarette comprises: the atomization assembly and a battery assembly. The atomization assembly comprises an atomization component and first electrodes, each first electrode comprises a base portion and a connecting portion, the connecting portion extends along a first direction of the electronic cigarette, and the base portion extends along a second direction basically perpendicular to the first direction. The battery assembly comprises second electrodes, each second electrode abuts against the base portion, and the second electrode extends in the first direction of the electronic cigarette and is deviated from the connecting portion. Good contact between the first electrodes of the atomization assembly and the second electrodes of the battery assembly can be ensured. In addition, the first electrodes are connected and fixed by means of the connecting portions, so that the overall structure is stable, and electrical connection is reliable.

18 Claims, 6 Drawing Sheets

(56) References Cited

U.S. PATENT DOCUMENTS

| | | | | |
|---|---|---|---|---|
| 2017/0325503 | A1 | 11/2017 | Liu | |
| 2019/0239568 | A1* | 8/2019 | Ouyang | H01M 50/579 |
| 2019/0246692 | A1* | 8/2019 | Li | A24F 1/00 |

FOREIGN PATENT DOCUMENTS

| | | | | | |
|---|---|---|---|---|---|
| CN | 207398236 | U | | 5/2018 | |
| CN | 109123812 | A | | 1/2019 | |
| CN | 208490858 | U | * | 2/2019 | A24F 47/00 |
| CN | 211910526 | U | | 11/2020 | |
| EP | 3569076 | A1 | | 11/2019 | |
| EP | 3569077 | A1 | | 11/2019 | |
| WO | 2016101142 | A1 | | 6/2016 | |

* cited by examiner

ATOMIZATION ASSEMBLY AND ELECTRONIC CIGARETTE

CROSS REFERENCE TO RELATED APPLICATION(S)

This application claims priority to Chinese Patent Application No. 201922073083.8, entitled "Atomization assembly and electronic cigarette" and submitted to China National Intellectual Property Administration on Nov. 26, 2019, the entire contents of which are incorporated herein by reference.

TECHNICAL FIELD

The present disclosure relates to the technical field of electronic cigarettes, and in particular to an atomization assembly and an electronic cigarette.

BACKGROUND

As people become growingly concerned about their health, more and more of them choose electronic cigarettes to help quit smoking. Different from conventional cigarettes of combustion type, electronic cigarettes, adopting a heating principle of non-combustion, are designed to heat a special aerosol generation product (tobacco or e-liquid) through an electronic heating element so that the aerosol generation product generates an aerosol, thereby achieving the same feeling of smoking.

Existing electronic cigarettes generally include an atomization assembly and a battery assembly in detachable connection with the atomization assembly. The atomization assembly includes an atomization component configured for atomizing an aerosol substrate material and a first electrode configured for transmitting electric energy. The first electrode is electrically connected to the atomization component. The battery assembly includes a battery and a second electrode electrically connected to the battery. When the atomization assembly is inserted and connected to the battery assembly, the second electrode of the battery assembly is aligned to and abuts against the first electrode of the atomization assembly to realize electrical connection. However, if the first electrode of the atomization assembly and the first electrode related members have errors in machining or assembling, it might occur that the first electrode and the second electrode that should be in contact have a clearance therebetween, and it is unable to perform flexible compensation according to different clearances, which finally results in poor contact.

SUMMARY

In order to solve the problem in existing technologies, the present disclosure provides an electronic cigarette which can ensure good contact between a first electrode of an atomization assembly and a second electrode of a battery assembly.

In a first aspect, the present disclosure provides an electronic cigarette, including an atomization assembly and a battery assembly configured for supplying power to the atomization assembly, wherein the atomization assembly includes an atomization component and a first electrode, the first electrode includes a base portion and a connecting portion, the connecting portion is arranged extending along a first direction of the electronic cigarette, a first end of the connecting portion is connected to the base portion, a second end of the connecting portion is electrically connected to the atomization component, and the base portion is arranged extending along a second direction basically perpendicular to the first direction; and the battery assembly includes a second electrode, the second electrode abuts against the base portion, and the second electrode is arranged extending along the first direction of the electronic cigarette and is deviated from the connecting portion.

In an embodiment, a center of orthographic projection of the connecting portion on a surface of the base portion facing the battery assembly is located at the geometric center of the surface of the base portion facing the battery assembly.

In an embodiment, a center of orthographic projection of the connecting portion on a surface of the base portion facing the battery assembly is spaced from the geometric center of the surface of the base portion facing the battery assembly.

In an embodiment, the number of the first electrode is two as a minimum, and a distance, along the second direction, between the connecting portions of the adjacent first electrodes is a first predetermined distance; the number of the second electrode is two as a minimum, and a distance, along the second direction, between the adjacent second electrodes is a second predetermined distance; and the second predetermined distance is greater than the first predetermined distance.

In an embodiment, the base portion includes a first end and a second end that are arranged opposite in position; and, in the second direction, the connecting portion has a greater distance to an end edge of the first end of the base portion than to an end edge of the second end of the base portion.

In an embodiment, the base portion and the connecting portion are a one-piece structure, or the base portion and the connecting portion are in riveted connection.

In an embodiment, the battery assembly further includes a magnetic element; the magnetic element and the base portion attract each other magnetically.

In an embodiment, the magnetic element is sleeved on the second electrode.

In an embodiment, a gap is formed between the magnetic element and the base portion.

In an embodiment, the second electrode abuts against the base portion elastically.

In an embodiment, the second electrode includes an electrode sleeve, an electrode column and an elastic element; the electrode column runs through the electrode sleeve and abuts against the base portion, a first end of the elastic element abuts against the electrode column and a second end of the elastic element abuts against the electrode sleeve, and the elastic element is configured for applying to the electrode column an elastic force toward the base portion.

In an embodiment, the atomization assembly further includes a first accommodation component, and the first accommodation component is configured for accommodating an aerosol substrate material; the atomization component is housed in the first accommodation component to atomize the aerosol substrate material; the first electrode is connected to the first accommodation component, a peripheral surface of the connecting portion is provided with a buckling protrusion, and the buckling protrusion is in buckled connection with the first accommodation component.

In an embodiment, the connecting portion abuts against the atomization component.

In an embodiment, the atomization component includes a porous body and an electric heating element; the porous body is configured for absorbing the aerosol substrate material, the electric heating element is attached onto the porous body to atomize the aerosol substrate material, and the connecting portion abuts against the electric heating element.

In an embodiment, the first accommodation component includes a liquid storage sleeve, a first sealing seat and a fixing seat; the liquid storage sleeve includes a sleeve body portion and an air tube portion, a liquid storage cavity configured for accommodating the aerosol substrate material is formed inside the sleeve body portion, the air tube portion is housed in the liquid storage cavity and is connected to the sleeve body portion; the first sealing seat is housed in the liquid storage sleeve and is connected to the air tube portion, to prevent the aerosol substrate material flowing into the air tube portion; and the fixing seat is located on an end part of the liquid storage sleeve and is connected to the sleeve body portion, the atomization component is located between the first sealing seat and the fixing seat, and the first electrode is fixed on the fixing seat.

In a second aspect, the present disclosure provides an atomization assembly, configured for combining with a battery assembly to form an electronic cigarette, wherein the atomization assembly includes an atomization component and a first electrode, the first electrode includes a base portion and a connecting portion, the connecting portion is arranged extending along a first direction of the electronic cigarette, a first end of the connecting portion is connected to the base portion, a second end of the connecting portion is electrically connected to the atomization component, and the base portion is arranged extending along a second direction basically perpendicular to the first direction and includes at least one surface, a center of orthographic projection of the connecting portion on the surface is spaced from the geometric center of the surface.

The present disclosure has the following beneficial effects. The first electrode includes a base portion and a columnar connecting portion, the connecting portion is arranged extending along a first direction of the electronic cigarette, a first end of the connecting portion is connected to the base portion, a second end of the connecting portion is electrically connected to the atomization component, and the base portion is arranged extending along a second direction basically perpendicular to the first direction, the second electrode is arranged deviated from the connecting portion in the second direction, that is to say, the base portion has a relatively big area in the second direction, thus ensuring good contact between the first electrode of the atomization assembly and the second electrode of the battery assembly; such a design reduces the difficulty in design, eases production and manufacturing, adapts the atomization component to various specifications of battery assemblies, and enhances the design flexibility of the atomization component. In addition, the first electrode is connected and fixed by means of the connecting portion, so that the overall structure is stable, and electrical connection is reliable.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

DETAILED DESCRIPTION

For a better understanding, the present disclosure is described below in further detail in conjunction with accompanying drawings and specific embodiments.

Figure 1:
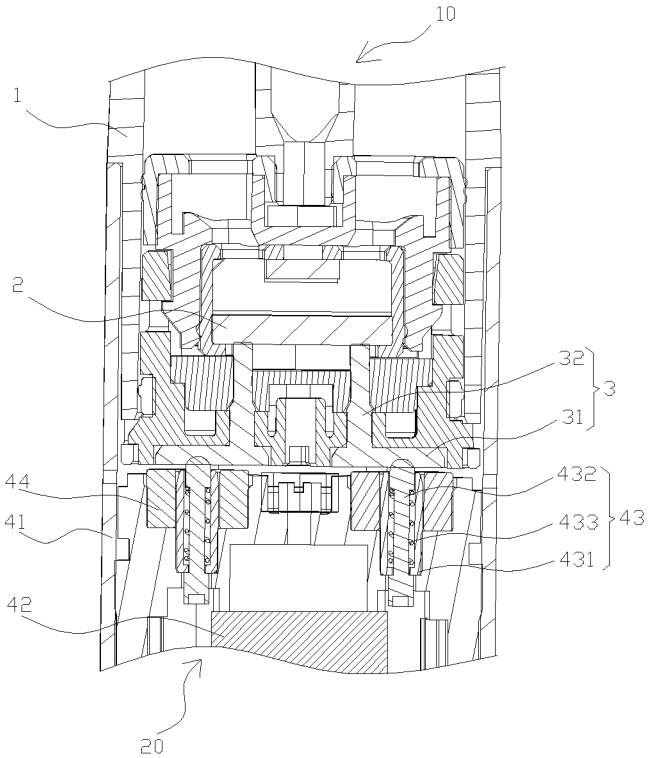
FIG. 1 is a structure diagram of an electronic cigarette according to one preferred embodiment of the present disclosure.
Figure 2:
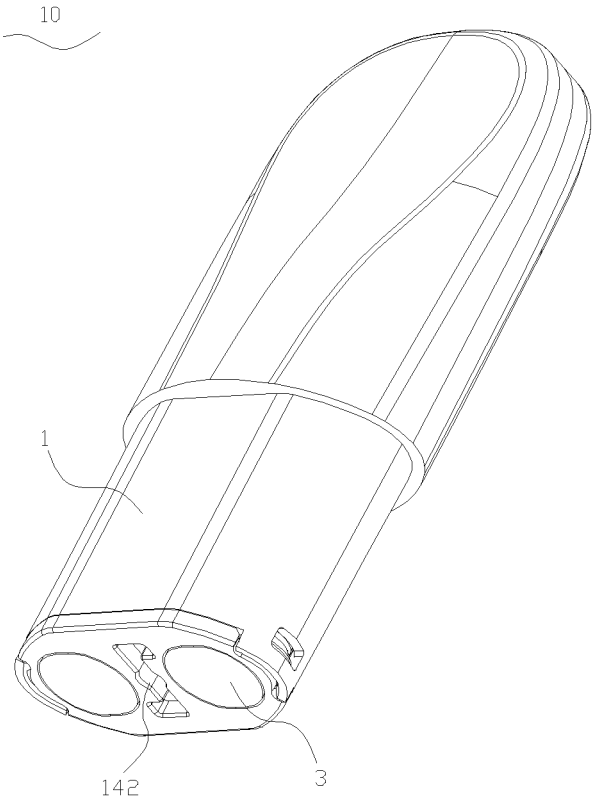
FIG. 2 is a perspective view of an atomization assembly according to one embodiment.
Figure 3:
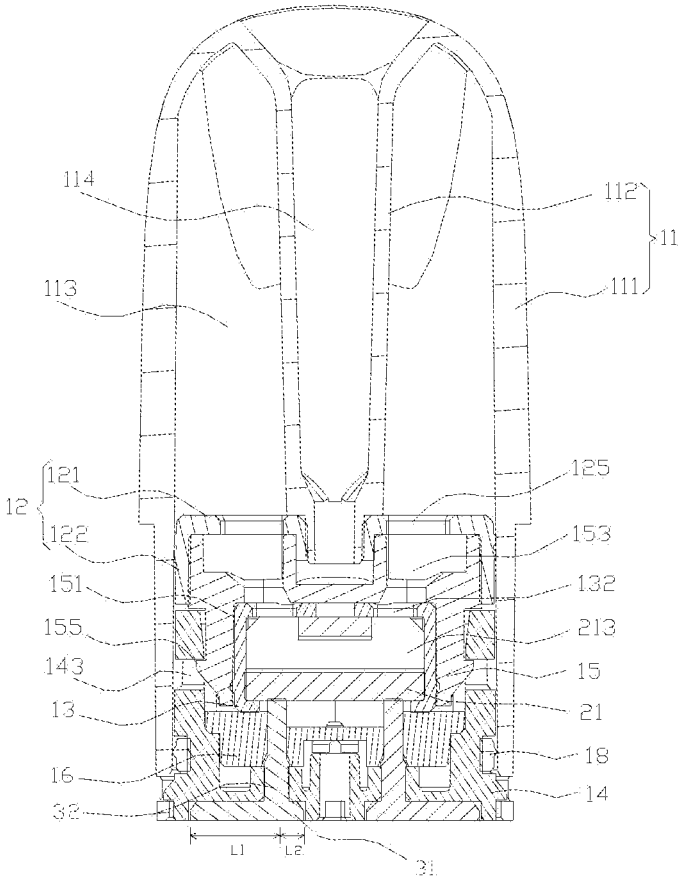
FIG. 3 is a sectional view of an atomization assembly according to one embodiment from one perspective.

With reference to FIG. 1 to FIG. 3, the present disclosure provides an electronic cigarette, including an atomization assembly 10 and a battery assembly 20 configured for supplying power to the atomization assembly 10, the atomization assembly 10 includes a first accommodation component 1, an atomization component 2 and a first electrode 3, the first accommodation component 1 is configured for accommodating an aerosol substrate material, the aerosol substrate material may be a solid or liquid, etc., and in the present embodiment, the aerosol substrate material is a liquid.

The first accommodation component 1 includes a liquid storage sleeve 11, a first sealing seat 12, a second sealing seat 13, a fixing seat 14, a locating seat 15 and a barrier plate 16; the liquid storage sleeve 11 includes a sleeve body portion 111 and an air tube portion 112; a liquid storage cavity 113 configured for accommodating the aerosol substrate material is formed inside the sleeve body portion 111, the air tube portion 112 is housed in the liquid storage cavity 113 and is connected to the sleeve body portion 111, an aerosol channel 114 is formed inside the air tube portion 112, and an aerosol formed by atomization of the aerosol substrate material is discharged through the aerosol channel 114. In the present embodiment, the sleeve body portion 111 and the air tube portion 112 are a one-piece structure. In some embodiments, the sleeve body portion 111 and the air tube portion 112 may be in detachable connection or indirect connection.

Figure 4:
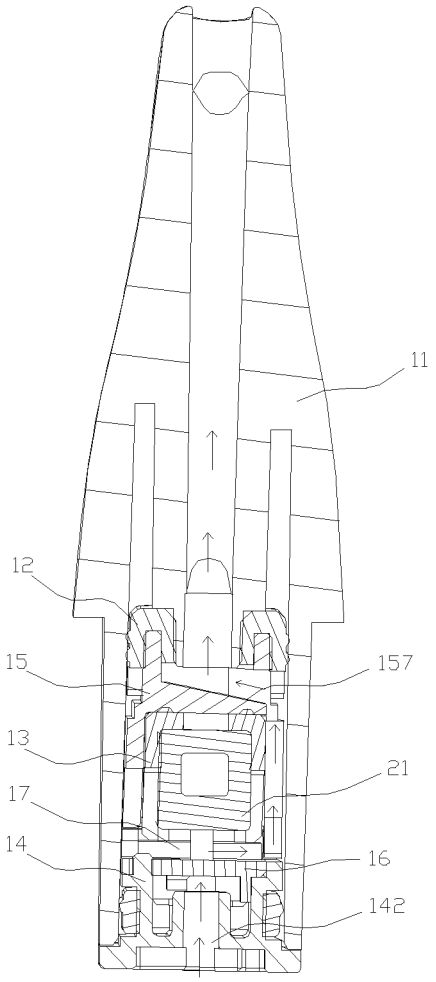
FIG. 4 is a sectional view of an atomization assembly according to one embodiment from another perspective.
Figure 5:
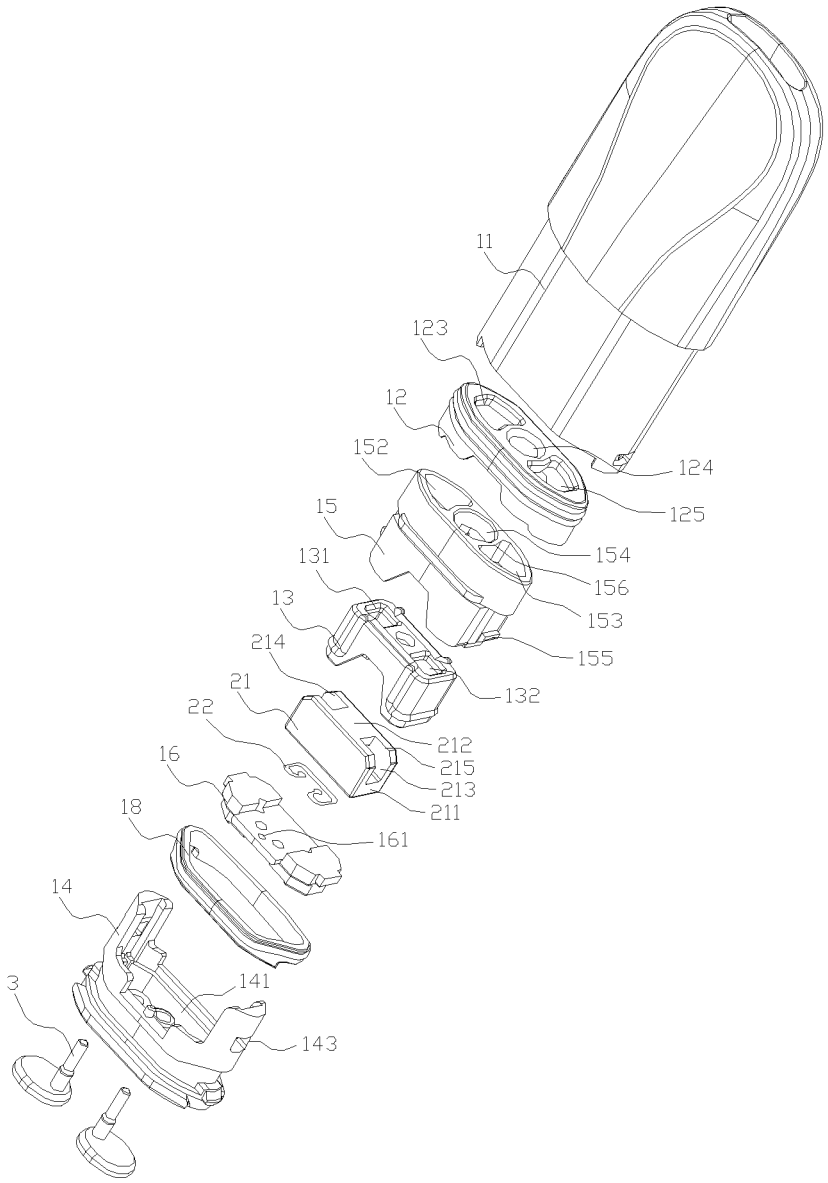
FIG. 5 is an exploded view of an atomization assembly according to one embodiment.

With reference to FIG. 3 to FIG. 5, the first sealing seat 12 is housed in the liquid storage sleeve 11 and is connected to the air tube portion 112, to prevent the aerosol substrate material flowing into the air tube portion 112; the first sealing seat 12 includes a cover body portion 121 and a sealing ring portion 122, the cover body portion 121 extends towards the fixing seat 14 to form the sealing ring portion 122, the cover body portion 121 is arranged to cover the cavity opening of the liquid storage cavity 113, the sealing ring portion 122 is sleeved on a peripheral surface of the locating seat 15 and abuts against an inner wall surface of the sleeve body portion 111 elastically.

The cover body portion 121 defines a first perforation 123, a second perforation 123 and a third perforation 125; the first perforation 123 and the third perforation 125 are located at two opposite sides of the position of the second perforation 124, and both of the first perforation 123 and the third perforation 125 are communicated with the liquid storage cavity 113. The position of the second perforation 124 corresponds to the position of the air tube portion 112, and end part of the air tube portion 112 is inserted into the second perforation 124 and is in interference fit with a hole wall of the second perforation 124. The second sealing seat 13 defines a liquid guide hole communicated with the liquid storage cavity 113, the liquid guide hole includes a first liquid guide hole 131 and a second liquid guide hole 132, the first liquid guide hole 131 corresponds to the first perforation 123 in position, the second liquid guide hole 132 corresponds to the third perforation 125 in position, so that the liquid guide hole is communicated with the liquid storage cavity 113 through the first perforation 123 and the third perforation 125. The second sealing seat 13 further defines a through hole, which is located between the first liquid guide hole 131 and the second liquid guide hole 132.

Figure 6:
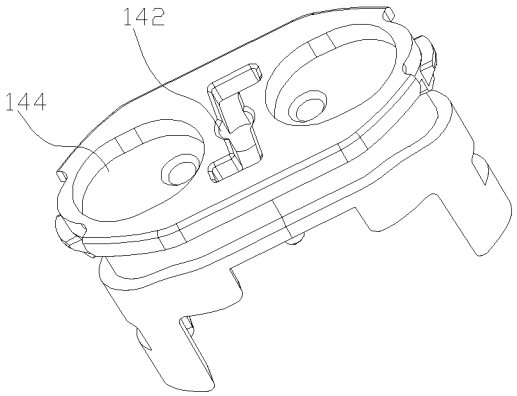
FIG. 6 is a perspective view of a fixing seat of an atomization assembly according to one embodiment.

With reference to FIG. 5 and FIG. 6, the fixing seat 14 is located on an end part of the e-liquid storage sleeve 1 and is connected to the sleeve body portion 111, a holding tank 141 is defined inside the fixing seat 14, the second sealing seat 13 is sleeved on the atomization component 2 and is located inside the holding tank 141. A bottom wall of the holding tank 141 defines an air inlet 142, and the air inlet is communicated with an external surface of the electronic cigarette and the aerosol channel 114, to guide external air of the electronic cigarette into the electronic cigarette. A side wall of the holding tank 141 defines a buckling hole 143, the number of the buckling hole 143 is two, and the two buckling holes 143 are arranged opposite in position. One end surface of the fixing seat 14 away from the liquid storage cavity 113 defines a locating groove 144. A peripheral surface of the fixing seat 14 is sleeved with an elastic ring 18, and the elastic ring 18 abuts against an inner wall surface of the sleeve body portion 111 elastically, thus better preventing leakage of e-liquid.

The locating seat 15 is located between the first sealing seat 12 and the fixing seat 14 and is connected to the fixing seat 14, the locating seat 15 defines an accommodation groove 151, a first liquid through-hole 152, a second liquid through-hole 153 and an abutting slot 154; the accommodation groove 151 is located on one side of the locating seat 15 away from the liquid storage cavity 113, the second sealing seat 13 is inserted into the accommodation groove 151, an external surface of the locating seat 15 is provided with a buckling hook 155, and the buckling hook 155 is in buckled connection with the buckling hole 143.

The first liquid through-hole 152 corresponds to the first liquid guide hole 131 in position, the second liquid through-hole 153 corresponds to the second liquid guide hole 132 in position, and the locating seat 15 is provided with a support portion 156 between the first liquid through-hole 152 and the second liquid through-hole 153. An end part of the air tube portion 112 is inserted into the abutting slot 154, a slot wall of the abutting slot 154 facing the air tube portion 112 is provided with a diversion surface 157, and the diversion surface 157 forms an obtuse angle with the extending direction of the air tube portion 112, thereby being conducive to guiding air to flow into the air tube portion. Thus, the feeling of inhalation is smooth and user experience is good.

The barrier plate 16 is installed inside the holding tank 141 and is located between the atomization component 2 and the fixing seat 14. An air circulation gap 17 is formed between the barrier plate 16 and the atomization component 2, the barrier plate 16 defines an air hole 161 thereon, and the air hole 161 is communicated with the air inlet 142 and the air circulation gap 17, to guide the air flowing from the air inlet 142 to a bottom surface of the atomization component 2; therefore, when a user smokes, an external airflow can better carry away the aerosol formed by atomization of the aerosol substrate material and better guarantee the aerosol concentration. It is understandable that the no concrete limitation is made for the structure of the first accommodation component 1, as long as it can accommodate the atomization component 2 and the first electrode 3. For example, in some embodiments, the barrier plate 16 may not be provided. Of course, in some embodiments, the first accommodation component 1 may not be provided; in such a case, an aerosol substrate material is directly dropped on the atomization component 2 to be atomized, during the process of smoking.

The atomization component 2 is arranged inside the first accommodation component 1 to atomize the aerosol matrix material. Specifically, the atomization component 2 is located between the locating seat 15 and the fixing seat 14, the atomization component 2 includes a porous body 21 and an electric heating element 22, the porous body 21 is configured for absorbing the aerosol substrate material, the porous body 21 is a porous ceramic body, the second sealing seat 13 and the porous ceramic body are housed in the locating seat 15. It is understandable that the porous body 21 may also be made of materials such as fiber, and no concrete limitation is made here.

The porous ceramic body includes a main body portion 211 and a reinforced arm portion 212, the main body portion 211 defines a liquid storage groove 213, the reinforced arm portion 212 is located at the groove opening of the liquid storage groove 213 and is connected to the main body portion 211, and the reinforced arm portion 212 separates the groove opening into a first liquid inlet 214 and a second liquid inlet 215. Through the arrangement of the reinforced arm portion 212, the structural strength of the porous ceramic body is improved, so that the porous ceramic body is uneasy to be damaged during assembly and the yield of products is improved. The first liquid inlet 214 is communicated with the first liquid guide hole 131, and the second liquid inlet 215 is communicated with the second liquid guide hole 132. The top of the second sealing seat 13 is clamped between the support portion 156 and the reinforced arm portion 212. The through hole on the second sealing seat 13 is located corresponding to the support portion 156 and the reinforced arm portion 212; therefore, the second sealing seat 13 has a relatively large deformation space between the support portion 156 and the reinforced arm portion 212, and the reinforced arm portion 212 is uneasy to be pressed and damaged.

The electric heating element 22 is attached onto the porous body 21 to atomize the aerosol substrate material, the electric heating element 22 may be an electric heating wire, an electric heating sheet or a conducive layer printed onto the porous body 21, etc., and no concrete limitation is made here. The second sealing seat 13 is sleeved on the porous body 21, and the aerosol substrate material inside the liquid storage cavity 113 is guided into the porous body 21 through the liquid guide hole.

Figure 7:
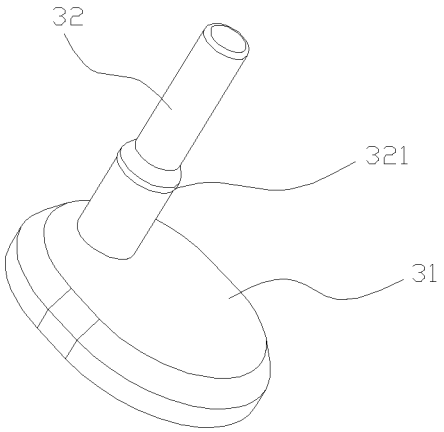
FIG. 7 is a perspective view of a first electrode of an atomization assembly according to one embodiment.

With reference to FIG. 3 and FIG. 7, the first electrode 3 is fixed on the fixing seat 14, to achieve connection with the first accommodation component 1. The first electrode 3 includes a base portion 31 and a columnar connecting portion 32, the connecting portion 32 is arranged extending along a first direction of the electronic cigarette, a first end of the connecting portion 32 is connected to the base portion 31, a second end of the connecting portion 32 is electrically connected to the atomization component 2, and the base portion 31 is arranged extending along a second direction basically perpendicular to the first direction and is inserted into the locating groove 144, that is, the base portion 31 and the connecting portion 32 may be perpendicular to each other, or may form an angle close to 90 degrees.

A peripheral surface of the connecting portion 32 is provided with a buckling protrusion 321, and the buckling protrusion 321 is in buckled connection with the first accommodation component 1, thus better avoiding the first electrode 3 falling off. The connecting portion 32 abuts against the atomization component 2, specifically, the connecting portion 32 abuts against the electric heating element 22, without welded connection and the like. The production and maintenance are convenient. In an embodiment, the base portion 31 and the connecting portion 32 are a one-piece structure, or the base portion 31 and the connecting portion 32 are in riveted connection, thus the connection is relatively secure and reliable.

The base portion 31 includes a first end and a second end that are arranged opposite in position; a center of orthographic projection of the connecting portion 32 on a surface of the base portion 31 facing the battery assembly 20 is staggered from the geometric center of the surface of the base portion 31 facing the battery assembly 20. In the second direction, the connecting portion 32 has a greater distance to an end edge of the first end of the base portion 31 than to an end edge of the second end of the base portion 31, that is to say, the connecting portion 32 is arranged deviated from the center of the base portion 31. In the present embodiment, the first direction is the longitudinal direction of the electronic cigarette, the second direction is the horizontal direction of the electronic cigarette, the number of the first electrode 3 is two, and the two first electrodes 3 are centrosymmetric with respect to the central line of the electronic cigarette. A distance, along the second direction, between the connecting portions 32 of the first electrodes 3 is a first predetermined distance.

In the second direction, the distance between the connecting portion 32 and the end edge of the first end of the base portion 31 is L1, and the distance between the connecting portion 32 and the end edge of the second end of the base portion 31 is L2. Of course, the first direction and the second direction may be defined as needed, and no concrete limitation is made here, as long as the first direction is the direction in which the atomization assembly 10 is in abutting joint with the battery assembly 20 to achieve electrical connection. It is understandable that the base portion 31 may present a circular shape, an oval shape or a square shape, etc., and no concrete limitation is made for the shape here.

Since, in the second direction, the connecting portion 32 has a greater distance to an end edge of the first end of the base portion 31 than to an end edge of the second end of the base portion 31, the atomization assembly 10 may be adapted to various specifications of battery assemblies 20.

In some embodiments, the base portion 31 presents a circular shape; a center of orthographic projection of the connecting portion 32 on a surface of the base portion 31 facing the battery assembly 20 is located at the geometric center of the surface of the base portion 31 facing the battery assembly 20, which may reduce the difficulty in design and manufacturing.

With reference to FIG. 1, the battery assembly 20 includes a second accommodation component 41, a battery 42, a second electrode 43 and a magnetic element 44, wherein the battery 42 is housed in the second accommodation component 41, the second electrode 43 is connected to the second accommodation component 41 and is electrically connected to the battery 42, a center of orthographic projection of the second electrode 43 on a surface of the base portion 31 facing the battery assembly 20 is staggered from a center of orthographic projection of the connecting portion 32 on a surface of the base portion 31 facing the battery assembly 20, the second electrode 43 is arranged deviated from the connecting portion 32 in the second direction, that is to say, the second electrode 43 and the connecting portion 32 are not on one same straight line. The magnetic element 44 is sleeved on the second electrode 43, making the connection between the first electrode 3 and the second electrode 43 more secure. The magnetic element 44 and the base portion 31 attract each other magnetically; a gap is formed between the magnetic element 44 and the base portion 31, thereby better avoiding the magnetic element 44 being hit against by the first electrode 3 and improving the service life of the magnetic element.

The second electrode 43 includes an electrode sleeve 431, an electrode column 432 and an elastic element 433; the electrode sleeve 431 is fixed on the second accommodation component 41, the electrode column 432 runs through the electrode sleeve 431 and abuts against the base portion 31, a first end of the elastic element 433 abuts against the electrode column 432 and a second end of the elastic element 433 abuts against the electrode sleeve 431, and the elastic element 433 is configured for applying to the electrode column 432 an elastic force toward the base portion 31. The second electrode 43 abuts against the base portion 31 elastically, which achieves a reliable electrical connection.

In the present embodiment, the elastic element 433 is a spring, and the spring is sleeved on the electrode column 432. The number of the second electrodes 43 is two, and a distance, along the second direction, between the second electrodes 43 is a second predetermined distance; the second predetermined distance is greater than the first predetermined distance. Such a design can be adapted to various atomization components 2, thus enhancing the flexibility of design of the atomization component 2, that is, during the process of design, the shape and structure of the atomization component 2 is uneasy to be influenced by the first electrode. It is understandable that the number of the first electrode 3 and the second electrode 43 may be set as needed, and no concrete limitation is made for the number here.

To sum up, the first electrode 3 includes a base portion 31 and a columnar connecting portion 32, the connecting portion 32 is arranged extending along a first direction of the electronic cigarette, a first end of the connecting portion 32 is connected to the base portion 31, a second end of the connecting portion 32 is electrically connected to the atomization component 2, and the base portion 31 is arranged extending along a second direction basically perpendicular to the first direction, the second electrode 43 is arranged deviated from the connecting portion 32 in the second direction, that is to say, the base portion 31 has a relatively big area in the second direction, thus ensuring good contact between the first electrode 3 of the atomization assembly 10 and the second electrode 43 of the battery assembly 20; such a design reduces the difficulty in design, eases production and manufacturing, adapts the atomization component 10 to various specifications of battery assemblies 20, and enhances the design flexibility of the atomization component 2. In addition, the first electrode 3 is connected and fixed by means of the connecting portion 32, so that the overall structure is stable, and electrical connection is reliable.

It is to be noted that the description of the present disclosure and the drawings just list some preferred embodiments of the present disclosure and are not limited to the embodiments described herein. Further, for the ordinary staff in this field, improvements or variations may be made according to the above description, and these improvements or variations are intended to be covered within the scope of protection of the claims appended hereinafter.

What is claimed is:

1. An electronic cigarette, comprising an atomization assembly and a battery assembly configured for supplying power to the atomization assembly, wherein the atomization assembly comprises an atomization component and a first electrode, the first electrode comprises a base portion and a connecting portion, the connecting portion is arranged extending along a first direction of the electronic cigarette, a first end of the connecting portion is connected to the base portion, a second end of the connecting portion is electrically connected to the atomization component, and the base portion is arranged extending along a second direction basically perpendicular to the first direction; and the battery assembly comprises a second electrode, the second electrode abuts against the base portion, and the second electrode is arranged extending along the first direction of the electronic cigarette and is deviated from the connecting portion;

wherein the battery assembly further comprises a magnetic element; the magnetic element and the base portion attract each other magnetically.

2. The electronic cigarette according to claim 1, wherein the base portion and the connecting portion are a one-piece structure, or the base portion and the connecting portion are in riveted connection.

3. The electronic cigarette according to claim 1, wherein the magnetic element is sleeved on the second electrode.

4. The electronic cigarette according to claim 1, wherein a gap is formed between the magnetic element and the base portion.

5. The electronic cigarette according to claim 1, wherein the second electrode abuts against the base portion elastically.

6. The electronic cigarette according to claim 5, wherein the second electrode comprises an electrode sleeve, an electrode column and an elastic element; the electrode column runs through the electrode sleeve and abuts against the base portion, a first end of the elastic element abuts against the electrode column and a second end of the elastic element abuts against the electrode sleeve, and the elastic element is configured for applying to the electrode column an elastic force toward the base portion.

7. The electronic cigarette according to claim 1, wherein a center of orthographic projection of the connecting portion on a surface of the base portion facing the battery assembly is located at the geometric center of the surface of the base portion facing the battery assembly.

8. The electronic cigarette according to claim 7, wherein the number of the first electrode is two as a minimum, and a distance, along the second direction, between the connecting portions of the adjacent first electrodes is a first predetermined distance; the number of the second electrode is two as a minimum, and a distance, along the second direction, between the adjacent second electrodes is a second predetermined distance; and the second predetermined distance is greater than the first predetermined distance.

9. The electronic cigarette according to claim 7, wherein the base portion and the connecting portion are a one-piece structure, or the base portion and the connecting portion are in riveted connection.

10. The electronic cigarette according to claim 1, wherein a center of orthographic projection of the connecting portion on a surface of the base portion facing the battery assembly is staggered from the geometric center of the surface of the base portion facing the battery assembly.

11. The electronic cigarette according to claim 10, wherein the base portion comprises a first end and a second end that are arranged opposite in position; and, in the second direction, the connecting portion has a greater distance to an end edge of the first end of the base portion than to an end edge of the second end of the base portion.

12. The electronic cigarette according to claim 10, wherein the number of the first electrode is two as a minimum, and a distance, along the second direction, between the connecting portions of the adjacent first electrodes is a first predetermined distance; the number of the second electrode is two as a minimum, and a distance, along the second direction, between the adjacent second electrodes is a second predetermined distance; and the second predetermined distance is greater than the first predetermined distance.

13. The electronic cigarette according to claim 1, wherein the atomization assembly further comprises a first accommodation component, and the first accommodation component is configured for accommodating an aerosol substrate material; the atomization component is housed in the first accommodation component to atomize the aerosol substrate material.

14. The electronic cigarette according to claim 13, wherein the connecting portion abuts against the atomization component.

15. The electronic cigarette according to claim 14, wherein the atomization component comprises a porous body and an electric heating element; the porous body is configured for absorbing the aerosol substrate material, the electric heating element is attached onto the porous body to atomize the aerosol substrate material, and the connecting portion abuts against the electric heating element.

16. The electronic cigarette according to claim 13, wherein the first accommodation component comprises a liquid storage sleeve, a first sealing seat and a fixing seat; the liquid storage sleeve comprises a sleeve body portion and an air tube portion, a liquid storage cavity configured for accommodating the aerosol substrate material is formed inside the sleeve body portion, the air tube portion is housed in the liquid storage cavity and is connected to the sleeve body portion; the first sealing seat is housed in the liquid storage sleeve and is connected to the air tube portion, to prevent the aerosol substrate material flowing into the air tube portion; and the fixing seat is located on an end part of the liquid storage sleeve and is connected to the sleeve body portion, the atomization component is located between the first sealing seat and the fixing seat, and the first electrode is fixed on the fixing seat.

17. The electronic cigarette according to claim 13, wherein the first electrode is connected to the first accommodation component, a peripheral surface of the connecting portion is provided with a buckling protrusion, and the buckling protrusion is in buckled connection with the first accommodation component.

18. An atomization assembly, configured for combining with a battery assembly comprising a magnetic element to form an electronic cigarette, wherein the atomization assembly comprises an atomization component and a first electrode, the first electrode comprises a base portion and a connecting portion, the connecting portion is arranged extending along a first direction of the electronic cigarette, a first end of the connecting portion is connected to the base portion, a second end of the connecting portion is electrically connected to the atomization component, and the base portion is arranged extending along a second direction basically perpendicular to the first direction and comprises at least one surface, a center of orthographic projection of the connecting portion on the surface is spaced from the geometric center of the surface;

wherein atomization assembly is configured such that the base portion attracts the magnetic element of the battery assembly magnetically.

* * * * *